US010082361B2

(12) United States Patent
Forsythe et al.

(10) Patent No.: US 10,082,361 B2
(45) Date of Patent: Sep. 25, 2018

(54) PORTABLE WIRELESS ELECTRICAL WEAPON

(71) Applicant: Forsythe & Storms Technologies LLC, Oak Creek, WI (US)

(72) Inventors: Lorne M. Forsythe, Oak Creek, WI (US); Christopher J. Storms, Milwaukee, WI (US); Joseph R. Patzer, Gillett, WI (US)

(73) Assignee: FORSYTHE & STORMS TECHNOLOGIES LLC, Oak Creek, WI (US)

( * ) Notice: Subject to any disclaimer, the term of this patent is extended or adjusted under 35 U.S.C. 154(b) by 364 days.

(21) Appl. No.: 15/066,009

(22) Filed: Mar. 10, 2016

(65) Prior Publication Data

US 2016/0265868 A1 Sep. 15, 2016

Related U.S. Application Data

(60) Provisional application No. 62/133,446, filed on Mar. 15, 2015.

(51) Int. Cl.
*F41B 9/00* (2006.01)
*F41H 13/00* (2006.01)
(Continued)

(52) U.S. Cl.
CPC ..... *F41B 9/009* (2013.01); *F41A 17/06* (2013.01); *F41A 17/38* (2013.01); *F41B 9/0021* (2013.01);
(Continued)

(58) Field of Classification Search
CPC ..... F41B 9/09; F41B 9/009; F41B 9/0021; F41B 9/0065; F41B 9/0071; F41B 9/0075;
(Continued)

(56) References Cited

U.S. PATENT DOCUMENTS 2,249,608 A 7/1941 Greene
3,374,708 A 3/1968 Wall
(Continued)

FOREIGN PATENT DOCUMENTS

CN 2048953 U 12/1989
CN 2096037 U 2/1992
CN 102364293 A 2/2012

OTHER PUBLICATIONS

PhaZZer Enforcer Complete Set—Black w/ Data Port, http://www.phazzerstore.com/PhaZZer-Enforcer-Complete-Set--Black-w-Data-port_p_158.html, printed Mar. 30, 2016.
(Continued)

*Primary Examiner* — Zeev V Kitov
(74) *Attorney, Agent, or Firm* — Husch Blackwell LLP

(57) ABSTRACT

The present disclosure provides a portable wireless electroshock device. The portable wireless electroshock device includes (A) a fluid reservoir containing a conductive fluid and (B) a pump in fluid communication with the fluid reservoir and a terminal having an orifice. The orifice is operable to emit a fluid stream trajectory of the conductive fluid there-through, and the terminal is operable to deliver an electrical current through the fluid stream trajectory.

5 Claims, 2 Drawing Sheets

(51) Int. Cl.
*F41A 17/06* (2006.01)
*F41A 17/38* (2006.01)

(52) U.S. Cl.
CPC ..... *F41B 9/0065* (2013.01); *F41B 9/0071* (2013.01); *F41B 9/0075* (2013.01); *F41H 13/0037* (2013.01)

(58) Field of Classification Search
CPC ..... F41A 17/06; F41A 17/38; F41A 13/0037; F41H 13/0037
See application file for complete search history.

(56) References Cited

U.S. PATENT DOCUMENTS 3,658,432 A * 4/1972 Lanusse ..... B05C 17/0341 15/24
3,971,292 A 7/1976 Paniagua
4,022,350 A 5/1977 Amron
4,034,497 A 7/1977 Yanda
4,051,762 A 10/1977 Ashley
4,281,582 A 8/1981 Jaqua
4,406,848 A 9/1983 Simpson
4,846,044 A 7/1989 Lahr
4,852,454 A 8/1989 Batchelder
4,982,645 A 1/1991 Abboud
5,103,366 A 4/1992 Battochi
5,225,623 A 7/1993 Krasnow
5,409,638 A * 4/1995 Battochi ..... F41B 9/0031 106/1.11
5,472,145 A 12/1995 Shannon et al.
5,586,688 A 12/1996 Johnson et al.
5,625,525 A 4/1997 Coakley et al.
5,779,099 A 7/1998 D'Andrade
6,123,069 A * 9/2000 Davis ..... A61M 16/0808 128/202.26
6,564,687 B2 5/2003 Poole
6,636,412 B2 10/2003 Smith
6,679,180 B2 1/2004 Warnagiris et al.
7,042,696 B2 5/2006 Smith et al.
7,280,340 B2 10/2007 Smith et al.
7,676,972 B2 3/2010 Smith et al.
7,900,388 B2 3/2011 Brundula et al.
8,074,993 B2 12/2011 Andersen et al.
8,484,876 B2 7/2013 Mossberg et al.
8,733,251 B1 5/2014 Abboud et al.
9,010,003 B2 4/2015 Brundula et al.
9,025,304 B2 5/2015 Brundula et al.
2002/0144446 A1* 10/2002 Lindahl ..... F41C 9/00 42/1.16
2003/0151880 A1 8/2003 Lee
2008/0047459 A1 2/2008 Novelli
2009/0237857 A1 9/2009 Kao

OTHER PUBLICATIONS

Jaycor Electromagnetic & Electronic Systems, Water Cannon, http://web.archive.org/web/20040626083201/http://www.jaycor.com/eme/watcan.htm, printed Mar. 30, 2016.
PhaZZer vs. Taser, https://phazzer.com/Product-Info/phazzer-vs-taser, printed Mar. 30, 2016.
Bernet et al., Physics, Chapter 28: Electrical Conduction in Liquids and Solids, (1958), paper 154, 524-538.
Electrified water cannon, Wikipedia, https://en.wikipedia.org/wiki/Electrified_water_cannon, printed Mar. 30, 2016.
Electroshock weapon, Wikipedia, https://en.wikipedia.org/wiki/Electroshock_weapon, printed Mar. 30, 2016.
Discovery.Com, Water Stun Gun, Mythbusters (Season 6, Episode 14), Sep. 17, 2008, Beyond Entertainment, U. S., http://www.discovery.com/tv-shows/mythbusters/videos/water-stun-gun/.
Super Soaker Central, How water guns work, http://www.sscentral.org/physics/works.html, printed Mar. 30, 2016.
Super Soaker Central, Water nozzles and efficiency, hffp://www.sscentral.org/physics/nozzles.html, printed Mar. 30, 2016.

* cited by examiner

PORTABLE WIRELESS ELECTRICAL WEAPON

BACKGROUND

The present disclosure relates to a portable wireless electroshock device.

In recent years, there has been growing social unrest over law enforcement's use of lethal force against unarmed citizens. Thus, a growing demand exists for less-lethal technological alternatives in order to incapacitate aggressive, violent, combative, or high-risk subjects who pose a risk to law enforcement, military, corrections, private security, licensed citizens, and/or the public.

Conventional conducted electrical weapons (CEWs) generally have two operative mechanisms to create a physiologically effective electric shock impulse, which interferes with superficial muscle functions and/or causes short term pain to the target. The first mechanism is a "stun gun," which induces a pain shock within the local receptor nerve endings in the surface layers of the tissues and muscles of the target. This is typically accomplished by contacting two terminals of an electrode to the target, which requires a user to be in close proximity to the target. The second mechanism is an Electro-Muscular Disruption (EMD) device, which is designed to overcome the skeletal musculature of the target via penetration of current pulses into deep muscle layers. This is typically accomplished by firing projectiles that facilitate a shock via thin conductive wires in electrical contact with a barbed dart, which penetrates the target.

Conventional EMD devices only allow for a limited number of shots or rounds before the cartridges are expended—typically between one and two shots can be fired before a new cartridge is required. This can pose a major risk to law enforcement and/or other users if the limited ammunition does not fire properly or make full contact with the target. In scenarios such as these, officers might then require alternative means of force, such as lethal weapons and/or bludgeoning batons to protect themselves from a hostile target. A limited number of shots also prevent users from being able to use the EMD device on multiple targets, such as in scenarios where crowd control is required.

Additionally, the tethered barbed darts of EMD devices that puncture the target are, by their design, invasive and may need to be surgically removed from a target. Upon removal, the tethered barbed darts pose a blood-borne pathogen disease risk to others. Moreover, the tethered barbed darts are considered medical sharps and must be disposed of as bio-hazardous waste.

Conventional EMD devices can at times be inaccurate. This inaccuracy is partly by design because the two pronged darts are necessarily ejected away from the EMD device in two slightly different directions, usually between 6 to 8 degrees. The tethered barbed darts must hit the target at some distance apart from one another in order to avoid electrical arcing between the barbed darts themselves, which may result in failure to cause a shock to the intended target. Inaccuracy can lead to unintended puncture wounds to vital areas such as a target's eyes, face, head, throat, chest area, groin, genitals, breast, or known areas of pre-existing injury.

A third, lesser-used operative mechanism for CEWs includes the use of conductive fluid to create a physiologically effective electric shock impulse. Conventional conductive fluid CEWs, also known as wireless electrical weapons (WEWs), are limited in that the devices use multiple fluids stored in separate containers, adding unnecessary complexity and modes of failure to the device. Additionally, conventional WEWs require the user to wear an inconvenient earth-ground coupling wire, making them less user-friendly and adding additional modes of failure.

The conductive fluid compositions used in conventional WEWs also pose problems. For example, a conventional conductive fluid composition containing a conductive material such as semi-powdered silver can corrode when in contact with rubber gaskets that are used as liquid seals in WEW designs, forming silver sulfide if left in contact for extended periods of time. Silver can also react with chlorine in water-based conductive fluid compositions, causing tarnish. This diminishes the conductivity of the fluid, may cause leakage in the device, and can clog filters and nozzles. Thus, the device's overall effectiveness is diminished over time. Another conventional conductive fluid composition contains mercury, which poses health and environmental risks.

The art recognizes the need for a portable wireless electroshock device that is capable of incapacitating and/or impeding the locomotion of a human or animal target without the need for tethered barbed darts. The art also recognizes the need for a portable, reliable and user-friendly wireless electrical weapon.

SUMMARY

The present disclosure provides a portable wireless electroshock device. The portable wireless electroshock device includes (A) a fluid reservoir containing a conductive fluid and (B) a pump in fluid communication with the fluid reservoir and a terminal having an orifice. The orifice is operable to emit a fluid stream trajectory of the conductive fluid there-through, and the terminal is operable to deliver an electrical current through the fluid stream trajectory.

The present disclosure also provides a portable wireless electroshock device including (A) a housing having a wall; (B) a fluid reservoir containing a conductive fluid, the fluid reservoir in fluid communication with two terminals and releasably attached to the housing via at least two spring loaded clip attachment arms, each of the two terminals having an orifice; and (C) an air pump fixed within the housing and in fluid communication with the fluid reservoir and ambient environment. Each of the two terminals extends through the wall of the housing and each orifice is operable to emit a fluid stream trajectory of the conductive fluid there-through. Each terminal is operable to deliver (i) an electrical current through the fluid stream trajectory and (ii) an electrical arching effect between the two terminals.

DEFINITIONS

The numerical ranges disclosed herein include all values from, and including, the lower and upper value. For ranged containing explicit values (e.g., 1 or 2; or 3 to 5; or 6; or 7), any subrange between any two explicit values is included (e.g., 1 to 2; 2 to 6; 5 to 7; 3 to 7; 5 to 6; etc.).

The terms "comprising," "including," "having," and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term, "consisting essentially of" excludes from the scope of any succeeding recitation any other component, step, or procedure, excepting those that are not essential to operability. The term "consisting of" excludes any component, step, or procedure not specifically delineated or listed. The term "or," unless stated otherwise, refers to the listed members individually as well as in any combination. Use of the singular includes use of the plural and vice versa.

Any reference to the Periodic Table of Elements is that as published by CRC Press, Inc., 1990-1991. Reference to a group of elements in this table is by the new notation for numbering groups.

Unless stated to the contrary, implicit from the context, or customary in the art, all parts and percents are based on weight and all test methods are current as of the filing date of this disclosure.

For purposes of United States patent practice, the contents of any referenced patent, patent application or publication are incorporated by reference in their entirety (or its equivalent US version is so incorporated by reference) especially with respect to the disclosure of definitions (to the extent not inconsistent with any definitions specifically provided in this disclosure) and general knowledge in the art.

DETAILED DESCRIPTION

Figure 1:
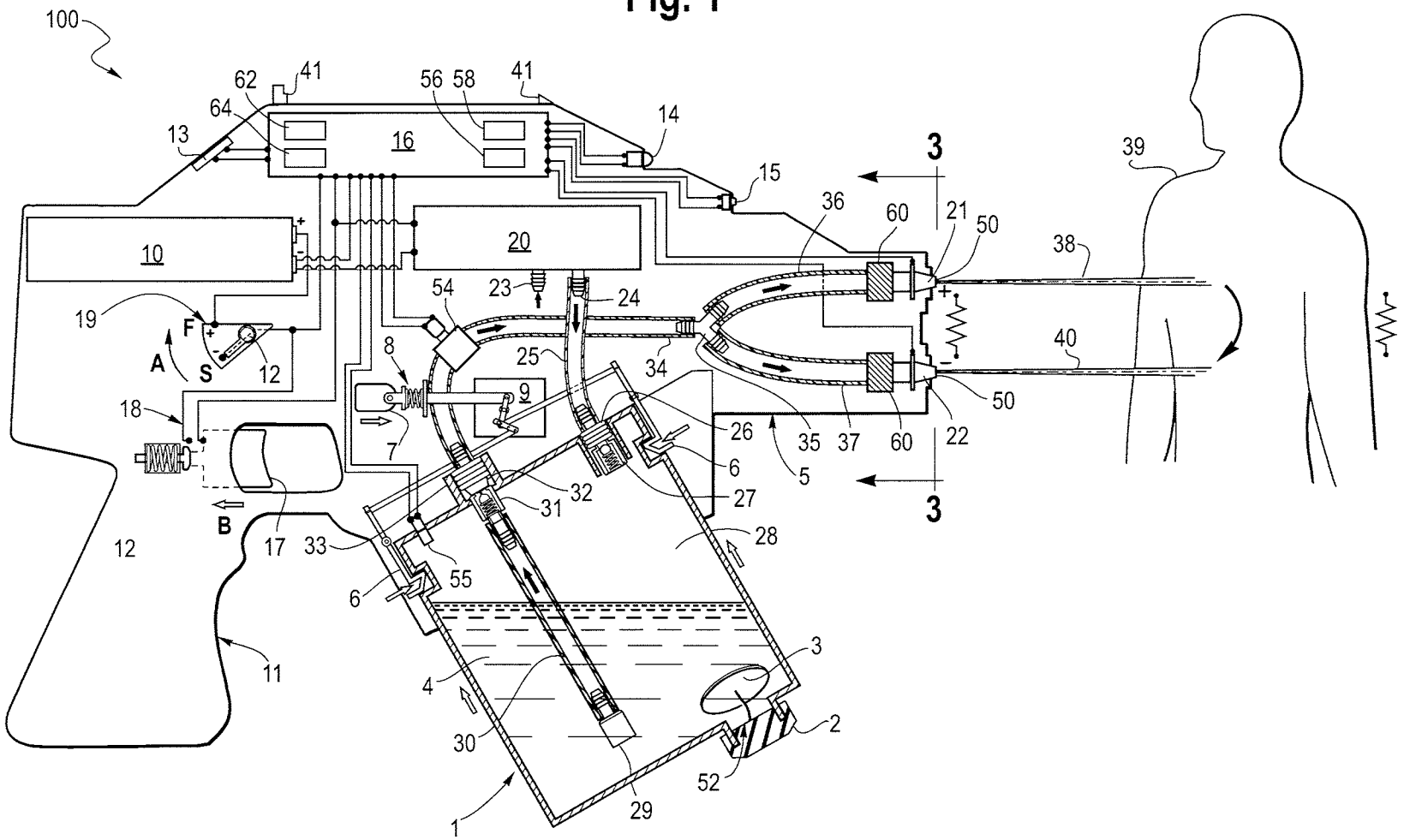
FIG. 1 is a cross-sectional view of a portable wireless electroshock device in accordance with an embodiment of the present disclosure.

The present disclosure provides a portable wireless electroshock device 100, as shown in FIG. 1. The portable wireless electroshock device includes a fluid reservoir 1 containing a conductive fluid 4 and a pump 20 in fluid communication with the fluid reservoir 1 and a terminal (21, 22) containing an orifice 50, the orifice 50 being operable to emit a fluid stream trajectory (38, 40) of a conductive fluid 4 there-through. The terminal (21, 22) containing an orifice 50 is operable to deliver an electrical current through the fluid stream trajectory (38, 40).

The present portable wireless electroshock device 100 is operable to incapacitate and/or impede the motion of a target 39.

FIG. 1 depicts a cross-sectional view of a portable wireless electroshock device 100 in accordance with an embodiment of the present disclosure.

A. Housing

The portable wireless electroshock device 100 includes a housing 5.

The housing 5 is formed from a rigid non-conductive material. The housing 5 has an interior, an exterior and a wall. The exterior of the housing 5 is in fluid communication with ambient environment. In an embodiment, the housing 5 is formed in a shape of a pistol or a water pistol.

The housing 5 may comprise two or more embodiments disclosed herein.

B. Fluid Reservoir

The portable wireless electroshock device 100 includes a fluid reservoir 1.

The fluid reservoir 1 is formed from a rigid non-conductive material. The fluid reservoir 1 defines a chamber capable of containing a conductive fluid 4. Although FIG. 1 depicts a fluid reservoir 1 located within the bottom of the housing and below the housing 5, it is understood that the fluid reservoir 1 may be located anywhere within the housing 5 and beside or above the housing 5, and combinations thereof. The portable wireless electroshock device 100 includes from 1, or 2 to 3, or 4, or 5 fluid reservoirs 1. In an embodiment, the portable wireless electroshock device 100 includes a single, or one and only one, fluid reservoir 1. The fluid reservoir 1 contains a conductive fluid 4.

The fluid reservoir 1 may be detachably connected to the housing 5 or fixed to and/or within the housing 5. FIG. 1 depicts a fluid reservoir 1 that is detachable. In an embodiment, a detachable fluid reservoir 1 is releasably attached to the housing 5 via spring loaded clip attachment arms 6, which are part of or mounted on the housing 5. In an embodiment, the portable wireless electroshock device includes from 1, or 2, or 3, to 4, or 5, or 6, or 10, or 15, or 20 spring loaded clip attachment arms 6. The detachable fluid reservoir 1 may be detached from the housing 5 using a mechanical lever 7, which is spring loaded 8 and mechanically coupled to a linkage assembly 9 that is mechanically connected to and operates the spring loaded clip attachment arms 6. A detachable fluid reservoir 1 is advantageous because it allows the user to quickly detach an empty fluid reservoir 1 and reload the portable wireless electroshock device 100 with a fluid reservoir 1 containing conductive fluid 4. This is especially advantageous in high-stress scenarios. Moreover, detachable fluid reservoirs 1 enhance the portability of the portable wireless electroshock device 100 because the user can carry refill fluid reservoirs 1. In an embodiment, the fluid reservoir 1 is filled with a conductive fluid 4 prior to being releasably attached to the housing 5.

In an embodiment, the fluid reservoir 1 has a refill opening 52 and a cap 2. The refill opening 52 is configured to receive the cap 2. Nonlimiting examples of suitable caps 2 include screw caps, flip-top caps, snap caps, stop-cocks, thumb plungers, and other types of removable and reclosable closures. The refill opening 52 and cap 2 advantageously allow a user to add conductive fluid 4 to the fluid reservoir 1 and/or remove conductive fluid 4 from the fluid reservoir 1 when the cap 2 is open. When the cap 2 is open, the interior of the fluid reservoir is in fluid communication with ambient environment. In an embodiment, the cap 2 is closed (i.e., not open). FIG. 1 depicts a closed cap 2.

In an embodiment, the cap 2 is connected to the fluid reservoir 1 via a tether 3. A tether 3 is a cord, fixture, or flexible attachment that anchors the cap 2 to the fluid reservoir 1.

The fluid reservoir 1 may comprise two or more embodiments disclosed herein.

C. Conductive Fluid

The fluid reservoir 1 contains a conductive fluid 4. A "conductive fluid" 4 is a substance that is in a liquid form at room temperature (about 23° C. (73° F.)) or is an ionized gas, that is able to conduct an electric current. In an embodiment, the conductive fluid 4 contains water and an additive. Additives are typically used to alter the fluid viscosity to increase the cohesiveness of a fluid stream trajectory (38, 40) upon exiting an orifice 50 and/or improve the conductivity of the conductive fluid 4. Nonlimiting examples of suitable additives include sodium chloride (NaCl), sodium hydroxide, potassium hydroxide, potassium chloride, magnesium chloride, nitric acid, calcium chloride, acetic acid, sulphuric acid, graphite, graphene, powdered metals, sodium polyacrylate, glycerin, a glycol, cornstarch, methyl cellulose, gelatin, a sugar and combinations thereof. In an embodiment, the conductive fluid is an electrolytic fluid that contains water and an additive that is an electrolyte such as sodium chloride (NaCl). In an embodiment, the additive increases the conductive fluid's 4 electrical conductivity by minimizing the formation of individual droplets when the conductive fluid 4 is emitted in a fluid stream trajectory (38, 40) from the portable wireless electroshock device 100, thus maximizing its range. A conductive fluid 4 containing a glycol has the additional advantage of minimizing the risk of freezing when the device is exposed to sub-freezing temperatures for long durations. A nonlimiting example of a suitable glycol is propylene glycol. In an embodiment, the conductive fluid 4 contains water and sodium chloride (i.e., a saline solution). In another embodiment, the conductive fluid 4 contains vinegar (i.e., a liquid containing water and acetic acid) and sodium chloride. In another embodiment, the conductive fluid 4 contains water, sodium chloride and glycerin. In another embodiment, the conductive fluid 4 contains water and sodium polyacrylate, and, optionally, sodium chloride.

In an embodiment, the conductive fluid 4 comprises an additive selected from an electrolyte, a glycol, a luminous phosphorescent, a chemiluminescent agent, a lachrymatory agent, and combinations thereof. In an embodiment, the conductive fluid 4 contains a luminous phosphorescent. Luminous phosphorescents and chemiluminescent agents can aid users in no/low light scenarios by allowing them to see where the conductive fluid 4 is making contact with a target 39. Nonlimiting examples of suitable luminous phosphorescents include zinc sulfide, strontium aluminate, and combinations thereof. A nonlimiting example of a suitable chemiluminescent agent is luminol ($C_8H_7N_3O_2$) in an alkaline solution with hydrogen peroxide and an oxidizing agent such as iron, copper, or an auxiliary oxidant. In an embodiment, the conductive fluid 4 contains a lachrymatory agent. A lachrymatory agent is a compound that causes eye, respiratory, and/or skin irritation. Nonlimiting examples of suitable lachrymatory agents include oleoresin capsaicin (OC), dibenzoxazepine (CR), phenacyl chloride (CN), 2-chlorobenzalmalononitrile (CS), nonivamide, bromoacetone, 2-butanol, propylene glycol, cyclohexane, dipropylene glycol methyl ether, and combinations thereof.

In an embodiment, the conductive fluid 4 is mercury-free. A "mercury-free" conductive fluid 4 is a conductive fluid 4 devoid of mercury or is otherwise free of mercury, the chemical element known under the symbol "Hg."

In an embodiment, the conductive fluid 4 is silver-free. A "silver-free" conductive fluid 4 is a conductive fluid devoid of silver or is otherwise free of silver, the chemical element known under the symbol "Ag."

In an embodiment, the fluid reservoir 1 contains from 60 milliliters (ml), or 70 ml, or 80 ml, or 90 ml, or 1,000 ml to 1,100 ml, or 1,200 ml, or 1,300 ml, or 1,400 ml, or 1,500 ml of the conductive fluid 4.

The conductive fluid 4 may comprise two or more embodiments disclosed herein.

D. Battery

The portable wireless electroshock device 100 includes a battery 10. The battery 10 is located within the housing 5. The battery 10 may be located anywhere within the housing 5.

The battery 10 may be detachably connected to the housing 5 or fixed within the housing 5. In an embodiment, the battery 10 is fixed within the housing 5 and the housing 5 includes a recharging port such that a user may recharge the battery 10. In another embodiment, the battery 10 is fixed within the housing 5 and the battery 10 may be recharged via inductive coupling through the housing 5 wall to a power supply such as an AC outlet. Inductive coupling has the advantage of allowing the battery 10 to be hermetically sealed within the housing 5, which prevents the possibility of being exposed to external environmental conditions and/or internal water leakage. In an embodiment, the battery 10 is hermetically sealed within the housing 5.

In an embodiment, the battery 10 has a voltage from 3 volts (V), or 5 V, or 8 V to 10 V, or 12 V, or 15 V. In an embodiment, the battery 10 has a voltage equal to or greater than 3 V.

The battery 10 may comprise two or more embodiments disclosed herein.

E. Electronics Housing

The portable wireless electroshock device 100 includes an electronics housing 16. The electronics housing 16 is formed from a rigid non-conductive material. The electronics housing 16 is located within the housing 5. The electronics housing 16 may be located anywhere within the housing 5. In an embodiment, the electronics housing 16 is hermetically sealed within the housing 5, which prevents the possibility of being exposed to external environmental conditions and/or internal water leakage.

The electronics housing 16 contains electrical components. Nonlimiting examples of electrical components contained in the electronics housing 16 includes a high voltage power converter 56; a transformer 58; user data collection and interface devices 64 (e.g., devices to measure and track pulse energy output, the number of shots taken, the duration of shots taken, and other relevant data that may be of use); various electronic circuitry 62 necessary to power the portable wireless electroshock device 100, provide safety interlocks, collect and report battery charge level, and various other features; an automatic timer; a motor-controller circuit; and combinations thereof. In an embodiment, the electronics housing 16 contains a high voltage power converter 56 and a transformer 58, which are electrically connected to the terminals (21, 22) and together supply the terminals (21, 22) with a high voltage electrical charge. In an embodiment, the high voltage power converter 56 and transformer 58 step-up the electrical charge coming from the battery 10 to a high voltage (HV) alternating current (AC) electrical charge. In an embodiment, the HV electrical charge has a voltage from 40,000 V, or 50,000 V to 60,000 V, or 70,000 V, or 80,000 V, or 90,000 V, or 100,000 V. In an embodiment, the HV electrical charge has a voltage equal to or greater than 50,000 V.

The electrical components contained in the electronics housing 16 are electrically connected to the battery 10, the pump 20, an interlock contact switch 19, an electrical contact switch 18, and the terminals (21, 22). In another embodiment, the electrical components contained in the electronics housing 16 are also electrically connected to at least one of a display screen 13, a flashlight 14, a laser sight 15, an electronic pressure sensor 55, and a solenoid actuated valve 54.

The electronics housing 16 and electrical components may comprise two or more embodiments disclosed herein.

E. Safety Control Switch

In an embodiment, the portable wireless electroshock device 100 includes a safety control switch 12. The safety control switch 12 operates an interlock contact switch 19. Moving the safety control switch 12 in the direction of arrow "A," as shown in FIG. 1, closes the interlock contact switch 19.

When the interlock contact switch 19 is closed, the battery 10 powers the electrical components contained in the electronics housing 16. In an embodiment, the battery 10 also powers a display screen 13 such as an LCD display screen, a flashlight 14 such as an LED flashlight, a laser sight 15, and combinations thereof. In an embodiment, the interlock contact switch 19 is closed.

The safety control switch 12 is visible to a user and operable from the exterior of the housing 5. In an embodiment, the exterior of the housing 5 is labeled with an "S" or the term "Safety" to define an open position for the safety control switch 12 and interlock contact switch 19, and an "F" or the term "Fire" to define a closed position for the safety control switch 12 and interlock contact switch 19.

The safety control switch 12 may comprise two or more embodiments disclosed herein.

F. Spring Loaded Trigger

The portable wireless electroshock device 100 includes a spring loaded trigger 17. The spring loaded trigger 17 operates an electrical contact switch 18. When a user pulls the spring loaded trigger 17, the electrical contact switch 18 is closed. When the spring loaded trigger 17 is in the released position, the electrical contact switch 18 is open. Moving the spring loaded trigger 17 in the direction of arrow "B," as shown in FIG. 1, closes the electrical contact switch 18. The trigger 17 is spring loaded to maintain tautness and prevent accidental closure of the electrical contact switch 18. When the electrical contact switch 18 is closed, power from the battery 10 is transferred to a pump 20 and a high voltage power converter 56 and transformer 58 contained within the electronics housing 16. The high voltage power converter 56 and transformer 58 are electrically connected to the terminals (21, 22) and together supply the terminals (21, 22) with a high voltage electrical charge.

A "shot" of the portable wireless electroshock device 100 is defined by the period in which both the electrical contact switch 18 and the interlock contact switch 19 are closed.

If the electrical contact switch 18 is closed without the interlock contact switch 19 also being closed, the portable wireless electroshock device 100 will not operate because the electrical components contained in the electronics housing 16 will not be powered by the battery 10. Thus, the combination of the electrical contact switch 18 and the interlock contact switch 19 prevent unintentional firing of the portable wireless electroshock device 100, which makes the portable wireless electroshock device 100 safer for a user.

The spring loaded trigger 17 may comprise two or more embodiments disclosed herein.

F. Hand Grip

In an embodiment, the portable wireless electroshock device 100 includes a hand grip 11. In an embodiment, the hand grip 11 is formed from the housing 5 or fixed to the exterior of the housing 5.

In an embodiment, a user can operate the safety control switch 12 while holding the hand grip 11.

In an embodiment, a user can operate the spring loaded trigger 17 while holding the hand grip 11.

The hand grip 11 may comprise two or more embodiments disclosed herein.

G. Terminals

In an embodiment, the portable wireless electroshock device 100 includes a HV positive terminal 21 operating with its corresponding negative terminal 22 (collectively, "the terminals"). While FIG. 1 depicts a distinct HV positive terminal 21 and a distinct negative terminal 22, the skilled artisan recognizes that in an AC circuit, the terminals (21, 22) oscillate between positive and negative charge. For purposes of this disclosure, when the terminals (21, 22) are referred to as a "HV positive terminal" or a "negative terminal," it is in reference to the charge of a terminal (21, 22) during one shot of the portable wireless electroshock device 100, with the understanding that during another shot of the portable wireless electroshock device 100, the charge of the terminals (21, 22) may or may not switch such that the HV positive terminal 21 of a first shot is the negative terminal 22 of a second shot.

The terminals (21, 22) extend through the wall of the housing 5. In an embodiment, the terminals (21, 22) extend from 1 mm, or 2 mm, or 3 mm, or 4 mm, or 5 mm, or 6 mm to 7 mm, or 8 mm, or 9 mm, or 10 mm, or 11 mm, or 12 mm, or 13 mm, or 14 mm, or 15 mm past the exterior of the housing 5.

Figure 3:
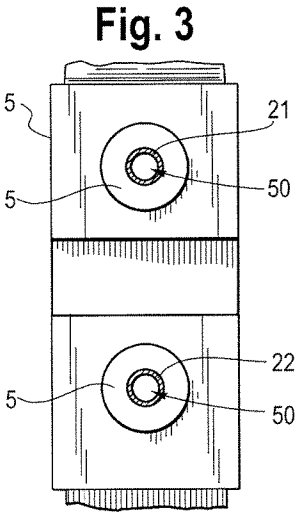
FIG. 3 is a front view of a portable wireless electroshock device taken along line 3-3 of FIG. 1 in accordance with an embodiment of the present disclosure.

Although FIGS. 1 and 3 depict an HV positive terminal 21 and a negative terminal 22 in a vertical configuration, whereby one terminal 21 is located above the other terminal 22, it is understood that the HV positive terminal 21 and the corresponding negative terminal 22 may have a horizontal configuration, whereby the terminals (21, 22) are side-by-side.

The terminals (21, 22) may be formed from a metal, a metal alloy, or metal plating. Nonlimiting examples of suitable metals, metal alloys, and metal plating include tungsten, aluminum, copper, molybdenum, nickel, chromium, manganese, niobium, palladium, titanium, platinum, gold, iron, zinc, brass, bronze, monel, inconel, hastelloy, cobalt base alloy, carbon steel, stainless steel, and combinations thereof.

Power is transferred from the battery 10 to the terminals (21, 22), via the high voltage power converter 56 and transformer 58, when the electrical contact switch 18 is closed. The terminals (21, 22) are electrically connected to the electrical contact switch 18, the battery 10, and the high voltage power converter 56 and transformer 58 contained within the electronics housing 16.

When power is transferred to the terminals (21, 22), an electric arching effect occurs between the HV positive terminal 21 and the corresponding negative terminal 22, thereby providing a stun gun feature to the portable wireless electroshock device 100, To utilize the stun gun feature, a user directly contacts a target 39 with the terminals (21, 22) (not shown in FIG. 1). The stun gun feature provides for direct contact incapacitation of a target.

The terminals (21, 22) may comprise two or more embodiments disclosed herein.

H. Pump

The portable wireless electroshock device 100 includes a pump 20. The pump 20 is located within the housing 5. The pump 20 may be located anywhere within the housing 5. Nonlimiting examples of suitable pumps include pneumatic air pumps, centrifugal pumps and screw type pumps.

The portable wireless electroshock device 100 includes from 1, or 2 to 3, or 4 pumps 20. In an embodiment, the portable wireless electroshock device 100 includes a single, or one and only one, pump 20.

In an embodiment, the pump 20 is a centrifugal pump or a screw type pump and the electronics housing 16 includes a motor-controller circuit.

In an embodiment, the pump 20 is a pneumatic air pump 20, as illustrated in FIG. 1. A pneumatic air pump 20 has at least two ports (23, 24), as illustrated in FIG. 1. At least one port 23 extends through the wall of the housing 5 and is in fluid communication with ambient environment, and at least one other port 24 is in fluid communication with tubing 25.

Power is transferred from the battery 10 to the pump 20 when the electrical contact switch 18 is closed. The pump 20 is electrically connected to the electrical contact switch 18, the battery 10, and the electrical components contained within the electronics housing 16.

After power is transferred to the air pump 20, the air pump 20 creates a suction to draw in air 28 from the ambient environment through the port 23 that is in fluid communication with ambient environment. The air pump 20 then pressurizes the drawn in air 28 such that the pressurized air 28 has a higher pressure than the ambient environment. Then, the air pump 20 discharges the pressurized air 28 through the other port 24. The pressurized air 28 from the pump 20 passes through the tubing 25 and into the fluid reservoir 1 through a seal assembly (26, 27) that includes a plurality of rubber gaskets 26 and a spring loaded check valve 27. The seal assembly (26, 27) prevents leakage of conductive fluid 4 between the fluid reservoir 1 and the housing 5. The relatively higher pressure on the top of the spring loaded check valve 27 forces the valve down, allowing the pressurized air 28 to enter the fluid reservoir 1. The tubing 25 is formed from non-conductive material.

The air pump 20 advantageously allows for a continuous and uninterrupted source of pressurized air 28 to the fluid reservoir 1, thus forming a pressurized reservoir system in the fluid reservoir 1 that operates as both a pressure chamber and a fluid reservoir. In contrast, conventional conductive fluid CEWs traditionally require pressurized gas cartridges, which contain a limited amount of pressurized gas, or a piston a user must manually pump to build pressure, such as in a conventional toy water gun. Devices that utilize pressurized gas cartridges contain an additional component that a user must monitor, and replace or refill and adds complexity to the device. Devices that utilize a manual piston require a user to have at least one hand on the piston, which detracts from a user's ability to maneuver the device, and requires the user to monitor and manually control the pressure in the device, which is timely and inconvenient. The absence of a pressurized gas cartridge, a separate gas tank, and a piston allows the present portable wireless electroshock device 100 to be smaller in size, and thus more portable, than conventional conductive fluid CEWs.

The pump 20 may comprise two or more embodiments disclosed herein.

I. Outlet Seal Assembly

After the pressurized air 28 enters the fluid reservoir 1, the pressurized air 28 contacts the conductive fluid 4 in the fluid reservoir and creates a positive pressure on the conductive fluid 4. The positive pressure forces the conductive fluid 4 into reservoir outlet tubing 30, and into an outlet seal assembly (31, 32, 33). The reservoir outlet tubing 30 is formed from non-conductive material. In an embodiment, the positive pressure forces the conductive fluid 4 through a mechanical filter 29 into reservoir outlet tubing 30, and into an outlet seal assembly (31, 32, 33). The mechanical filter 29 is operable to filter undissolved additives, such as sodium chloride crystals, from the conductive fluid 4. In an embodiment, the presence or absence of a mechanical filter 29 depends on the solubility of the additives in the conductive fluid 4.

The outlet seal assembly (31, 32, 33) includes a plurality of rubber gaskets 33 and a spring loaded check valve 31, which prevents unwanted conductive fluid 4 leakage from the fluid reservoir 1 into the housing 5. The outlet seal assembly spring loaded check valve 31 is held open via a mechanical depression 32. When the fluid reservoir 1 is a detachable fluid reservoir 1, the contact of the mechanical depression 32 onto the spring loaded check valve 31, once the fluid reservoir 1 is releasably attached to the housing 5 and positively gripped with the spring loaded clip attachment arms 6, maintains the check valve 31 in an open position for conductive fluid 4 to flow through the check valve 31of the outlet seal assembly.

After passing through the outlet seal assembly (31, 32, 33), the conductive fluid 4 passes through intermediary tubing 34. In an embodiment, the conductive fluid 4 is split into two fluid channels (36, 37) using a connection 35, such as a Y-connector or a T-connector, after passing through the intermediary tubing 34. In an embodiment, one of the fluid channels 36 is in fluid communication with the HV positive terminal 21 and the other fluid channel 37 is in fluid communication with the negative terminal 22. The intermediary tubing 34 and each of the fluid channels (36, 37) are formed from non-conductive material.

The outlet seal assembly (31, 32, 33) may comprise two or more embodiments disclosed herein.

J. Laminator

In an embodiment, the portable wireless electroshock device 100 includes a laminator 60. In an embodiment, the laminator 60 is located between the fluid channels (36, 37) and the terminals (21, 22). In an embodiment, a laminator 60 is located between each fluid channel (36, 37) and each terminal (21, 22).

Figure 2:
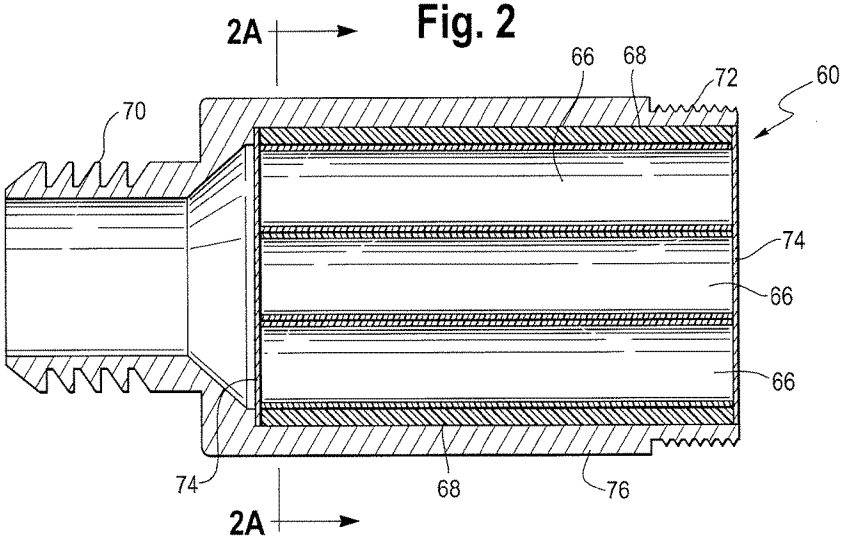
FIG. 2 is a side plan view of a laminator in accordance with an embodiment of the present disclosure.
Figure 2A:
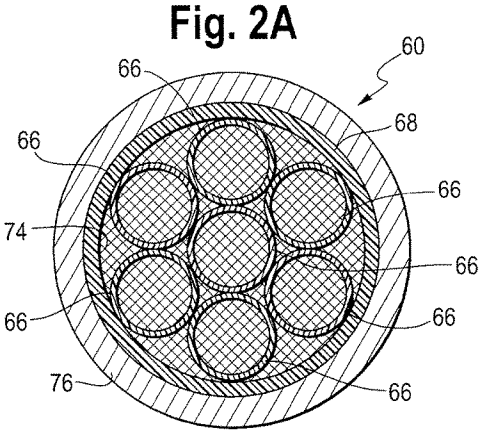
FIG. 2A is a cross-sectional view of a laminator taken along line 2A-2A of FIG. 2 in accordance with an embodiment of the present disclosure.

A laminator 60, also known as a "fluid straightener," has a sleeve 68 and plurality of axially aligned through ports 66, as shown in FIGS. 2 and 2A. The plurality of axially aligned through ports 66 extend through the sleeve 68 such that the fluid channels (36, 37) are in fluid communication with the terminals (21, 22). The plurality of axially aligned through ports 66 are configured in a radially arranged honeycomb array, as shown in FIG. 2A. In an embodiment, the laminator 60 includes from 3, or 4, or 5, or 6 to 7, or 8, or 9, or 10, or 15, or 20 axially aligned through ports 66. FIG. 2A depicts a laminator 60 with seven axially aligned through ports 66.

In an embodiment, the sleeve 68 is connected to the fluid channels (36, 37) via a hose connection 70.

In an embodiment, the sleeve 68 is connected to the terminals (21, 22) via a threaded connection 72. In another embodiment, the sleeve 68 is connected to terminal tubing via a hose connection 70, and the terminal tubing is in fluid communication with the terminals (21, 22).

In an embodiment, the laminator 60 includes a casing 76 around the sleeve 68, as shown in FIGS. 2 and 2A. The casing 76 is formed from non-conductive material. In an embodiment, the casing 76 is connected to the fluid channels (36, 37) via a hose connection 70, as shown in FIG. 2. In another embodiment, the casing 76 is connected to the terminals (21, 22) via a threaded connection 72, as shown in FIG. 2. In another embodiment, the casing 76 is connected to terminal tubing via a hose connection 70, and the terminal tubing is in fluid communication with the terminals (21, 22).

In an embodiment, the laminator 60 includes a screen mesh 74. In an embodiment, the screen mesh 74 is contained within the sleeve 68. In another embodiment, the screen mesh 74 is located at one or both ends of the sleeve 68, but is not contained within the sleeve 68, as shown in FIG. 2. In an embodiment, the laminator 60 includes a screen mesh 74 located between the hose connection 70 and the axially aligned through ports 66. In another embodiment, the laminator 60 includes a screen mesh 74 located between the axially aligned through ports 66 and the threaded connection 72. In another embodiment, the laminator includes two screen meshes 74, wherein one screen mesh 74 is located between the hose connection 70 and the axially aligned through ports 66, and the other screen mesh 74 is located between the axially aligned through ports 66 and the threaded connection 72, as shown in FIG. 2.

In an embodiment, after passing through the fluid channels (36, 37) the conductive fluid 4 flows through the plurality of axially aligned through ports 66, and then flows through the terminals (21, 22). In another embodiment, after passing through the fluid channels (36, 37) the conductive fluid 4 flows through the plurality of axially aligned through ports 66, through terminal tubing, and then flows through the terminals (21, 22). In another embodiment, after passing through the fluid channels (36, 37) the conductive fluid 4 flows through a screen mesh 74, through the plurality of axially aligned through ports 66, through a second screen mesh 74, and then flows through the terminals (21, 22). In another embodiment, after passing through the fluid channels (36, 37) the conductive fluid 4 flows through a screen mesh 74, through the plurality of axially aligned through ports 66, through a second screen mesh 74, through terminal tubing, and then flows through the terminals (21, 22).

In an embodiment, the portable wireless electroshock device 100 includes from 1 to 2, or 3, or 4, or 5, or 6, or 7, or 8, or 9, or 10 laminators 60.

The laminator 60 promotes cohesion and concentration of the fluid stream trajectory (38, 40) upon exiting the portable wireless electroshock device 100 at further distances from the portable wireless electroshock device 100. This results in improved electrical conductivity to and from the target 39.

K. Orifice

Each terminal (21, 22) is in the form of a nozzle and contains an orifice 50. The orifice 50 extends through the terminal (21, 22) such that the fluid channels (36, 37) are in fluid communication with ambient environment.

The orifice 50 has a shape from a cross-sectional view. Nonlimiting examples of suitable orifice 50 shapes include circle, oval, ovoid, triangle, square, rectangle, diamond, parallelogram, trapezoid, rhombus, pentagon, hexagon, octagon, nonagon, decagon and star. Each orifice 50 may have the same shape or a different shape. FIG. 3 depicts two orifices 50, each orifice 50 having a circle shape from a cross-sectional view.

In an embodiment, the orifice 50 has a conical shape, wherein the orifice 50 has two ends, and one end has a smaller diameter than the other end. When the orifice 50 has a conical shape, the fluid stream trajectory (38, 40) exits the portable wireless electroshock device 100 at the orifice 50 end with a smaller diameter.

The conductive fluid 4 passes through a terminal (21, 22) orifice 50 before the conductive fluid 4 exits the portable wireless electroshock device 100. The conductive fluid 4 exits the portable wireless electroshock device 100 as a fluid stream trajectory (38, 40). The terminals (21, 22) are operable to deliver a low current, high-voltage pulse through the fluid stream trajectory (38, 40) of conductive fluid 4. The fluid stream trajectory (38, 40) contacts a target 39.

The fluid stream trajectories (38, 40) have a laminar flow through the ambient environment. A laminar flow occurs when a fluid flows in parallel streams, with no disruption between the streams. The fluid stream trajectories (38, 40) are substantially continuous, or continuous. A continuous fluid stream trajectory (38, 40) has an uninterrupted path between the portable wireless electroshock device 100 and the target 39.

In an embodiment, the portable wireless electroshock device 100 includes from 1, or 2, or 3 to 4, or 5, or 6 HV positive terminals 21 and from 1, or 2, or 3 to 4, or 5, or 6 corresponding negative terminals 22, wherein each terminal (21, 22) has an orifice 50 and each orifice 50 is operable to emit a fluid stream trajectory (38, 40) of conductive fluid 4. FIG. 1 depicts a portable wireless electroshock device 100 with one HV positive terminal 21 and one negative terminal 22, wherein each terminal (21, 22) has an orifice 50 that is operable to emit a fluid stream trajectory (38, 40). When the portable wireless electroshock device 100 includes more than one orifice 50, the conductive fluid 4 is split into an equal number of fluid channels (36, 37) using a connection 35 after passing through the intermediary tubing 34.

The orifice 50 may comprise two or more embodiments disclosed herein.

L. Target

When the conductive fluid 4 passes through the HV positive terminal 21 orifice 50, electrical current flows from the HV positive terminal 21 into the conductive fluid 4 and through the fluid stream trajectory 38 that is contact with a target 39. The target 39 acts as a resistor, or a load, in an electrical circuit. The electrical circuit is completed when the electrical current returns to the negative terminal 22 from the target 39 through the fluid stream trajectory 40.

In another embodiment, after the conductive fluid 4 leaves the outlet seal assembly (31, 32, 33), the conductive fluid 4 passes through intermediary tubing 34 and directly to the HV positive terminal 21 orifice 50, as the only orifice 50 of the portable wireless electroshock device 100. In this embodiment, an electrical circuit is completed with a capacitive impedance between the portable wireless electroshock device 100 and the target 39, instead of the fluid stream trajectory 40 flowing from the negative terminal 22 described above.

A target 39 acting as a resistor in an electrical circuit may be incapacitated and/or have their movement impeded, thus immobilizing the target 39, due to interference between a target's 39 localized muscles and neural systems. The target 39 may be a human or an animal.

If the conductive fluid 4 separates into individual droplets from the fluid stream trajectory (38, 40) on its path to the target 39, the electrical resistance in the conductive fluid 4 path will be increased and can render the shot ineffective, meaning the target 39 is not incapacitated or immobilized. Not wishing to be bound by any particular theory, Applicant believes that for every 1-inch of space between the terminals (21, 22) and the target 39, an additional 75,000 Volts can be applied to each terminal (21, 22) to overcome the increased electrical resistance in the conductive fluid 4 path when the conductive fluid 4 separates into individual droplets and still be sufficient to incapacitate and/or immobilize the target 39. As discussed above, the conductive fluid 4 may contain an additive (e.g., glycerin) that minimizes the formation of individual droplets when the conductive fluid 4 is emitted in a fluid stream trajectory (38, 40).

After a user releases the spring loaded trigger 17, the electrical contact switch 18 opens and the power to the pump 20 ceases.

To completely turn off the portable wireless electroshock device 100, both the electrical contact switch 18 and the interlock contact switch 19 (operated by the safety control switch 12) are moved to the open position.

M. Additional Optional Components and Settings

In an embodiment, the present portable wireless electroshock device 100 includes an automatic timer, a solenoid actuated valve 54 and pressure sensor 55, a sight apparatus, a display screen 13, a flashlight 14, and combinations thereof.

In an embodiment, the electronics housing 16 contains an automatic timer. The automatic timer is an electrical component contained in the electronics housing 16. The automatic timer is electrically connected to the battery 10, the pump 20, the interlock contact switch 19, the electrical contact switch 18, and the terminals (21, 22). An automatic timer measures the duration of a complete electrical circuit and breaks the circuit by shutting off power to the terminals (21, 22) and/or the pump 20 if the spring loaded trigger 17 is pulled for an extended period of time. An automatic timer advantageously prevents permanent injury or death to the target 39, and/or damage to the portable wireless electroshock device 100.

In an embodiment, a solenoid actuated valve 54 is located down-stream of the fluid reservoir 1. The solenoid actuated valve 54 causes pressure to build in the fluid reservoir 1 after a user pulls the spring loaded trigger 17, which increases the speed of the conductive fluid 4 when it flows through the orifice 50. This provides a greater range to the fluid stream trajectory (38, 40). When the portable wireless electroshock device 100 includes a solenoid actuated valve 54, an electronic pressure sensor 55 is included within the fluid reservoir 1. The electronic pressure sensor 55 is electronically connected to the electrical components in the electronics housing 16 that control the solenoid actuated valve 54, which is electronically connected to the solenoid actuated valve 54.

In an embodiment, the portable wireless electroshock device 100 includes a sight apparatus. A sight apparatus aids a user when the user is aiming at a target 39. Nonlimiting examples of suitable sight apparatuses include laser sights 15, mechanical sights 41, and combinations thereof. In an embodiment, the sight apparatus is fixed to the exterior of the housing 5. In another embodiment, the sight apparatus extends through the wall of the housing 5 and is electrically connected to the electrical components contained in the electronics housing 16 and/or the battery 10.

In an embodiment, the portable wireless electroshock device 100 includes a display screen 13. A nonlimiting example of a suitable display screen 13 is an LCD display screen. The display screen 13 extends through the wall of the housing 5 and is electrically connected to the electrical components contained in the electronics housing 16 and/or the battery 10.

In an embodiment, the portable wireless electroshock device 100 includes a flashlight 14. A nonlimiting example of a suitable flashlight 14 is an LED flashlight. The flashlight 14 extends through the wall of the housing 5 and is electrically connected to the electrical components contained in the electronics housing 16 and/or the battery 10.

In an embodiment, the present portable wireless electroshock device 100 advantageously does not require the user to have an earth-ground coupling wire, which enhances the portability of the portable wireless electroshock device 100. In an embodiment, the portable wireless electroshock device 100 excludes an earth-ground coupling wire.

The present portable wireless electroshock device 100 does not require barbed darts to puncture the target 39. Thus, the risk of unintended puncture wounds to vital areas and transfer of blood-borne pathogens from the target 39 to personnel upon barbed dart removal is removed. Further, the present portable wireless electroshock device 100 does not generate biohazardous waste.

The portable wireless electroshock device 100 advantageously provides two mechanisms for incapacitating a target 39: (i) direct contact with the target 39 using the stun gun feature and (ii) fluid stream trajectory (38, 40) contact with the target 39.

The direct contact stun gun feature ensures the portable wireless electroshock device 100 complies with the "drive-stun" techniques often taught in law-enforcement training courses. Direct contact capabilities also ensure the safety of the user in the event the portable wireless electroshock device 100 runs out of conductive fluid 4 and cannot be refilled or a detachable fluid reservoir 1 cannot be replaced.

The fluid stream trajectory (38, 40) contact with the target 39 advantageously allows a user to incapacitate a target 39 that is not within the user's reach. Furthermore, the fluid stream trajectory (38, 40) contact allows the present portable wireless electroshock device 100 to advantageously engage multiple targets 39. In contrast, conventional EMD devices with tethered barbed darts are typically limited to a single target 39.

The portable wireless electroshock device 100 may comprise two or more embodiments disclosed herein.

It is specifically intended that the present invention not be limited to the embodiments and illustrations contained herein, but include modified forms of those embodiments including portions of the embodiments and combinations of elements of different embodiments as come within the scope of the following claims.

We claim:

1. A portable wireless electroshock device comprising:

a housing comprising a wall;

a fluid reservoir comprising a conductive fluid, the fluid reservoir in fluid communication with two terminals and releasably attached to the housing via at least two spring loaded clip attachment arms, each of the two terminals comprising an orifice;

an air pump fixed within the housing and in fluid communication with the fluid reservoir and ambient environment;

wherein the fluid reservoir is in fluid communication with a reservoir outlet tubing;

the reservoir outlet tubing is in fluid communication with an outlet seal assembly comprising a plurality of rubber gaskets, a spring loaded check valve, and a mechanical depression;

the outlet seal assembly is in fluid communication with an intermediary tubing;

the intermediary tubing is in fluid communication with each of the two terminals;

wherein each of the two terminals extends through the wall of the housing and each orifice is operable to emit a fluid stream trajectory of the conductive fluid therethrough; and each terminal is operable to deliver (i) an electrical current through the fluid stream trajectory and (ii) an electric arching effect between the two terminals.

2. The portable wireless electroshock device of claim 1, wherein the air pump is in fluid communication with a tubing;

the tubing is in fluid communication with a seal assembly comprising a second plurality of rubber gaskets and a second spring loaded check valve; and the seal assembly is in fluid communication with the fluid reservoir.

3. The portable wireless electroshock device of claim 1, wherein the conductive fluid comprises water and an additive.

4. The portable wireless electroshock device of claim 1 further comprising at least one of a flashlight, a laser sight, and a mechanical sight.

5. The portable wireless electroshock device of claim 1 further comprising two laminators, wherein each laminator is in fluid communication with the fluid reservoir and one of the two terminals.

* * * * *